United States Patent [19]

Suzuki et al.

[11] 4,338,778

[45] Jul. 13, 1982

[54] APPARATUS FOR DETECTING AN ERRONEOUSLY INSERTED EMPTY BOBBIN IN A SPINNING FRAME PROVIDED WITH AN AUTOMATIC DOFFING AND DONNING APPARATUS

[75] Inventors: Osamu Suzuki, Oobu; Takayuki Morita, Kariya; Masashi Ushino, Hekinan; Hideo Hirano, Aichi, all of Japan

[73] Assignee: Kabushiki Kaisha Toyoda Jidoshokki Seisakusho, Aichi, Japan

[21] Appl. No.: 162,807

[22] Filed: Jun. 25, 1980

[30] Foreign Application Priority Data

Jul. 10, 1979 [JP] Japan ..... 54/94802[U]

[51] Int. Cl.[3] ..... D01H 9/18

[52] U.S. Cl. ..... 57/276; 57/81; 57/274; 198/395; 198/401

[58] Field of Search ..... 57/264–278, 57/78, 80, 81, 83; 198/395, 401, 502; 221/21

[56] References Cited

U.S. PATENT DOCUMENTS

| | | | |
|---|---|---|---|
| 3,276,566 | 10/1966 | Raasch | 198/395 |
| 3,433,966 | 3/1969 | Letch et al. | 198/502 X |
| 3,730,325 | 5/1973 | Goodwin | 198/395 |
| 3,934,716 | 1/1976 | Heckel | 198/502 X |
| 3,938,308 | 2/1976 | Komura et al. | 57/266 |
| 4,014,161 | 3/1977 | Cox | 57/78 X |
| 4,018,040 | 4/1977 | Zerfoss et al. | 57/78 X |

*Primary Examiner*—John Petrakes

*Attorney, Agent, or Firm*—Burgess, Ryan and Wayne

[57] ABSTRACT

An apparatus for detecting an erroneously inserted empty bobbin is disposed on a spinning frame which is provided with an automatic doffing and donning apparatus and a conveyor having empty bobbin supporting pegs mounted thereon. The detecting apparatus photoelectrically or electromechanically detects whether or not an empty bobbin is correctly inserted onto the corresponding empty bobbin supporting peg based on the fact that an incorrectly inserted bobbin inclines backwards and projects upwards. When the incorrectly inserted bobbin is detected, an alarm is actuated in order to notify an operator in charge of the spinning frame of the same.

11 Claims, 13 Drawing Figures

APPARATUS FOR DETECTING AN ERRONEOUSLY INSERTED EMPTY BOBBIN IN A SPINNING FRAME PROVIDED WITH AN AUTOMATIC DOFFING AND DONNING APPARATUS

FIELD TO WHICH THE PRESENT INVENTION RELATES

The present invention relates to a spinning frame provided with an automatic doffing and donning apparatus, and more specifically, the present invention relates to an apparatus for detecting an erroneously inserted bobbin in a spinning frame provided with: an automatic doffing and donning apparatus; and a conveyor, having empty bobbin supporting pegs mounted thereon, for feeding empty bobbins to predetermined positions which are to be simultaneously donned onto spindles of the spinning frame by means of the doffing and donning apparatus.

A spinning frame provided with an automatic doffing and donning apparatus and a conveyor for feeding empty bobbins is well known. However, if an empty bobbin is incorrectly inserted onto a peg of the conveyor and is fed to a predetermined position, a bobbin catcher corresponding to the incorrectly inserted empty bobbin cannot grasp the incorrectly inserted empty bobbin because the top of the incorrectly inserted bobbin deviates from the normal position. Since the empty bobbin is not donned onto the corresponding spindle of the spinning frame, the spun yarn which is to be wound onto the empty bobbin, inserted onto the spindle of the spinning frame, is wound directly onto the spindle of the spinning frame and which causes it to be wasted. In addition, in some cases, due to the deviation between the top of the incorrectly inserted empty bobbin and the corresponding bobbin catcher of the bobbin doffing and donning apparatus, the incorrectly inserted empty bobbin and/or the bobbin catcher or other parts of the automatic bobbin doffing and donning apparatus may be damaged. Furthermore, if an empty bobbin is not inserted onto a peg of the conveyor, the bobbin catcher cannot grasp it. Accordingly, the empty bobbin is not donned, and spun yarn is similarly wasted because it is wound directly on the spindle.

SUMMARY OF THE INVENTION

An object of the present invention is to provide an apparatus for detecting an erroneously inserted empty bobbin, so that an operator of the spinning frame can repair the incorrect insertion of the empty bobbin before the automatic bobbin doffing and donning apparatus begins its donning operation. It is also an object of the invention to prevent damage to the bobbin doffing and donning apparatus and to minimize the waste of spun yarn.

According to the present invention, the object is accomplished by a spinning frame provided with: an automatic doffing and donning apparatus; and a conveyor, having empty bobbin supporting pegs mounted thereon, for feeding empty bobbins which are to be donned onto spindles of the spinning frame by means of the doffing and donning apparatus. The spinning frame according to the present invention is characterized in that it is further provided with a detecting apparatus which detects if an empty bobbin is correctly inserted onto any one of said empty bobbin supporting pegs.

According to the first embodiment of the present invention, the detecting apparatus is disposed at an empty bobbin outlet of the spinning frame and is so arranged that the upper and lower portions of each empty bobbin being inserted onto an empty bobbin supporting peg must pass through the detecting apparatus. More specifically, the detecting apparatus according to this embodiment comprises two pairs of light emitters and light receivers, one pair being disposed at the upper portion of empty bobbin outlet of the spinning frame and the other pair being disposed at the lower portion of the empty bobbin outlet, so that the light emitters face the corresponding light receivers. It is preferable that one of the two pairs is displaced relative to the other pair, with respect to the empty bobbin conveying direction. The amount of the displacement corresponds to one half of the difference in the outer diameters of the empty bobbin at the upper and lower portions. It is also preferable that the spinning frame further includes an alarm which is actuated based on output signals emitted from both light receivers and a pulse signal emitted in synchronization with the passage of the empty bobbin.

According to the second embodiment of the present invention, the detecting apparatus comprises: a detecting member which includes a support arm fixed to the spinning frame, a detecting plate swingably supported by the support arm and a follower plate fixed to the detecting plate and which is rotatably supported at a position just above the tops of the empty bobbins correctly inserted onto the empty bobbin supporting pegs; and a reed switch which is actuated by a magnet fixed to a front end of the follower plate when a bobbin is incorrectly inserted onto one of the empty bobbin supporting pegs.

According to the third embodiment of the present invention, the detecting apparatus comprises a pair composed of one light emitter and one light receiver, and the pair is so arranged that light emitted from the light emitter passes along the conveyor at a position just above the tops of the empty bobbins which are correctly inserted onto the empty bobbin supporting pegs so as to be received by the light receiver; but when the light is disturbed by a bobbin which is incorrectly inserted onto one of the empty bobbin supporting pegs, it is not received by the light receiver. In addition, in this embodiment, either one of the light emitter or the light receiver is so arranged that it can be moved between a stand-by position and a working position so that the device displaced to the stand-by position does not disturb the conveyance of the empty bobbins.

BRIEF DESCRIPTION OF THE DRAWINGS

Some embodiments of the present invention will now be explained in detail with reference to the accompanying drawings, wherein.

DETAILED DESCRIPTION OF THE INVENTION

Figure 1:
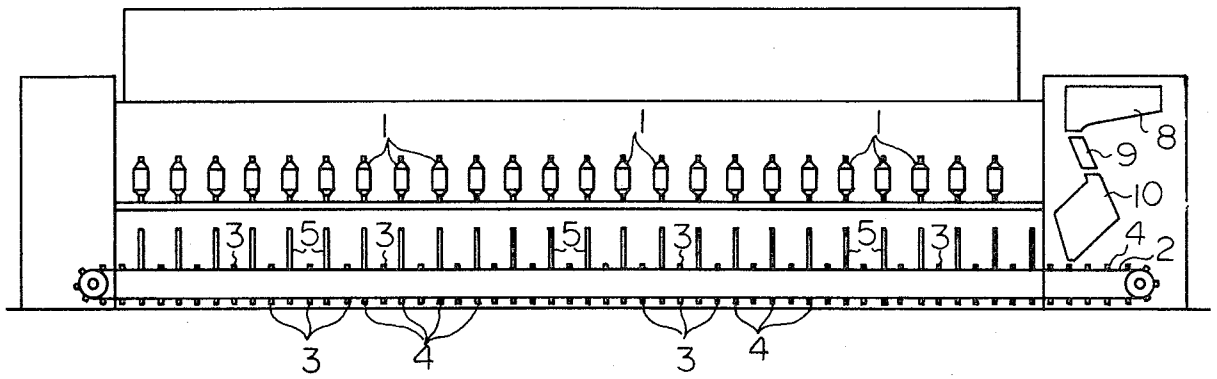
FIG. 1 is an elevational view of a spinning frame according to the present invention.
Figure 2:
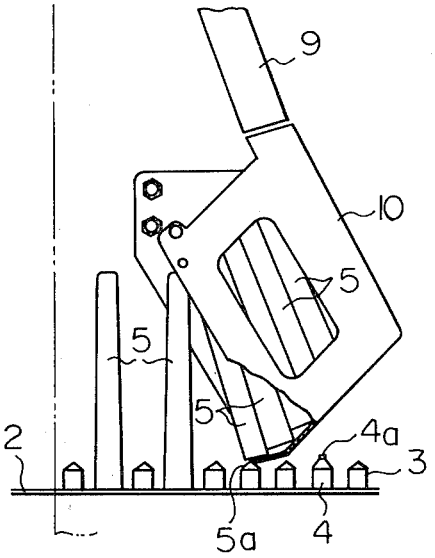
FIG. 2 is an enlarged partial elevational view of an empty bobbin feeding apparatus mounted on the spinning frame illustrated in FIG. 1.

Referring to FIG. 1, a spinning frame (not numbered) of the present invention is provided with: an automatic bobbin doffing and donning apparatus (not shown) which has a conventionally known construction; and a conveyor belt 2 which has a plurality of full bobbin supporting pegs 3 and empty bobbin supporting pegs 4 alternately mounted thereon. Full bobbins 1 formed on spindles (not shown) of the spinning frame are simultaneously doffed by the automatic bobbin doffing and donning apparatus and are simultaneously inserted onto the full bobbin supporting pegs 3, and then, empty bobbins 5 inserted onto the empty bobbin supporting pegs 4 are simultaneously grasped by the automatic bobbin doffing and donning apparatus and are simultaneously donned onto spindles of the spinning frame. In this spinning frame, before the empty bobbins 5 are conveyed by the conveyor belt 2 to positions corresponding to the respective spindles, a plurality of empty bobbins 5 stored within an empty bobbin storage box 8 which is disposed at one end of the spinning frame are fed one by one to an empty bobbin feeding apparatus 10, which is disposed beneath the empty bobbin storage box 8, via a guide member 9 as illustrated in FIG. 2. The empty bobbin 5 fed to the empty bobbin feeding apparatus 10 is discharged from the outlet thereof when an engaging projection 4*a* formed on the top of each empty bobbin supporting peg 4, which is attached to the conveyor belt 2 and which is moved towards the empty bobbin 5 together with the conveyor belt 2, is engaged with the lower, large portion 5*a* of the empty bobbin 5. Then, the empty bobbin is vertically dropped due to its gravity so as to be inserted onto the empty bobbin supporting peg 4 and is conveyed forwardly.

Figure 3:
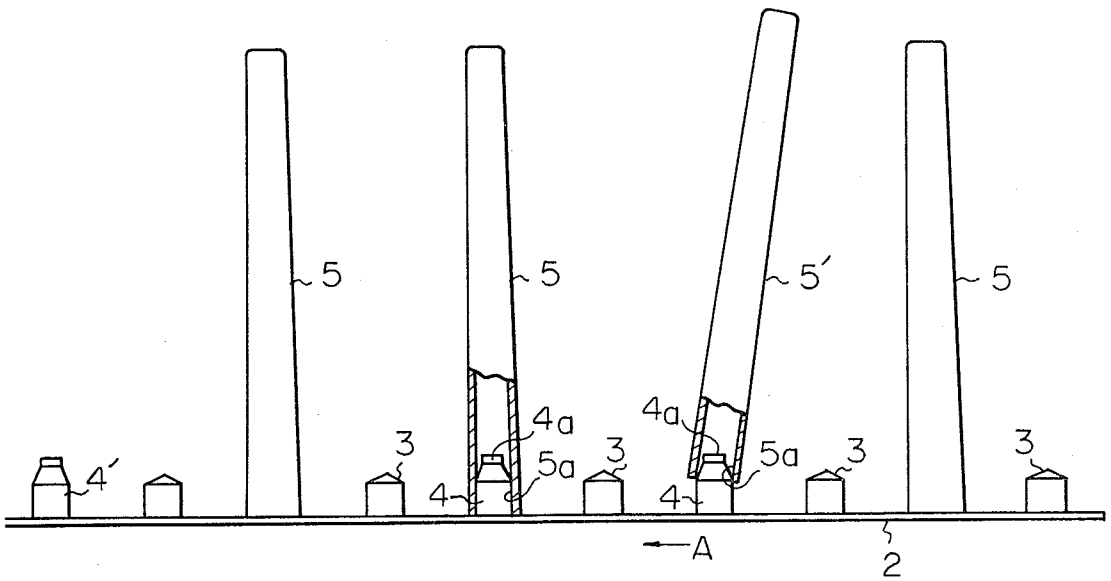
FIG. 3 is an enlarged elevational view which is utilized to explain some conditions wherein empty bobbins are inserted onto empty bobbin supporting pegs of a conveyor constituting the spinning frame illustrated in FIG. 1.

However, the empty bobbins 5 are inserted onto the empty bobbin supporting pegs 4 while the empty bobbin supporting pegs 4 are moving and accordingly, in some cases, as illustrated at the center of FIG. 3, some empty bobbins 5′ are not correctly inserted onto the empty bobbin supporting pegs 4, and such incorrectly inserted empty bobbin 5′ inclines backwards and projects upwards. When a bobbin doffing and donning operation is effected whereby the insertion of an inclined empty bobbin 5′ is not corrected, because of the disagreement between the top of the inclined empty bobbin 5′ and the corresponding bobbin catcher (not shown) of the bobbin doffing and donning apparatus, the inclined empty bobbin 5′ cannot be grasped by the bobbin catcher and in some cases, the inclined empty bobbin 5′ or the automatic bobbin doffing and donning apparatus may be damaged. In addition, if an empty bobbin 5 is not inserted onto the corresponding spindle of the spinning frame, due to the incorrect insertion of the empty bobbin 5′ onto an empty bobbin supporting peg 4, when the operation of the spinning frame is commenced, the spun yarn is wound directly onto the spindle.

Figure 4:
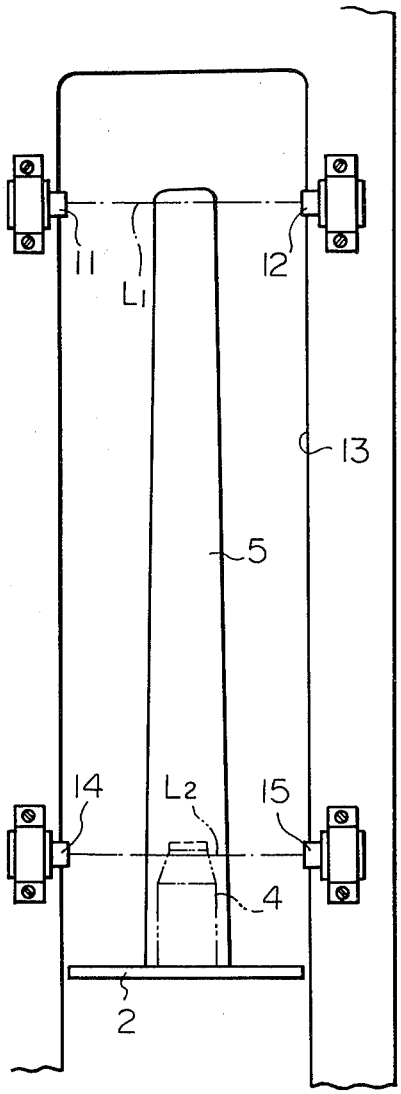
FIGS. 4 and 5 are side and elevational views of a first embodiment of a detecting apparatus according to the present invention.
Figure 5:
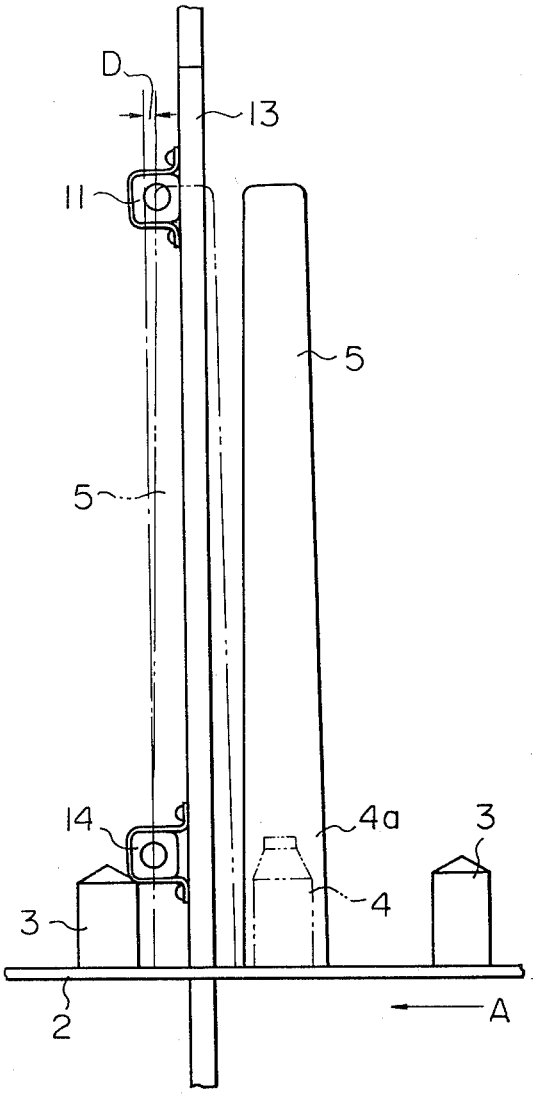

To prevent damage to the automatic doffing and donning apparatus and the inclined empty bobbin 5′, the spinning frame according to the present invention is provided with a detecting apparatus which detects whether or not an empty bobbin 5 is correctly inserted onto one of the empty bobbin supporting pegs 4 projecting from the conveyor belt 2. At the above-mentioned one end of the spinning frame where empty bobbins 5 are discharged, as illustrated in FIGS. 4 and 5, a pair of a light emitter 11 and a light receiver 12 is fixed to the upper portion of an empty bobbin outlet 13, so that the light emitter 11 faces the light receiver 12. The light emitter 11 and the light receiver 12 are so arranged that the passage $L_1$ of the upper light emitted from the light emitter 11 towards the light receiver 12 is interrupted by the upper portion of an empty bobbin which is correctly inserted onto the empty bobbin supporting peg 4. The light receiver 12 emits a pulse output signal SG1 (FIG. 7) when the light emitted from the light emitter 11 is interrupted by an empty bobbin 5 discharged through the empty bobbin outlet 13. Symbol $T_1$ in FIG. 7 denotes a time interval during which the upper portion of an empty bobbin 5 interrupts the upper passage $L_1$ of the light.

A pair composed of a light emitter 14 and a light receiver 15 is fixed to the lower portion of the empty bobbin outlet 13, so that the light emitter 14 faces the light receiver 15. A passage $L_2$ of the lower light emitted from the light emitter 14 towards the light receiver 15 is interrupted by the lower portion of an empty bobbin 5 when the empty bobbin is correctly inserted onto the empty bobbin supporting peg 4. The lower portion which interrupts the passage $L_2$ of the lower light is located lower than the tops of the empty bobbin supporting pegs 4 but higher than the tops of the full bobbin supporting pegs 3. The pair of the light emitter 14 and the light receiver 15 is displaced relative to the other pair of the light emitter 11 and the light receiver in a conveying direction of the conveyor belt 2, i.e., to the left in FIG. 5, by an amount D (FIG. 5) which is equal to one half of the difference between the diameters of the lower portion and the upper portion of the empty bobbin, so that the lower portion of the empty bobbin 5 begins to interrupt the passage $L_2$ of the lower light approximately at the same time the passage $L_1$ of the upper light is commenced to be interrupted by the upper portion of the empty bobbin 5. The light receiver 15 emits a pulse signal SG2 (FIG. 7) when the lower light emitted from the light emitter 14 is interrupted. Symbol $T_2$ in FIG. 7 denotes a time interval during which the lower portion of the empty bobbin 5 interrupts the passage $L_2$ of the lower light.

Figure 6:
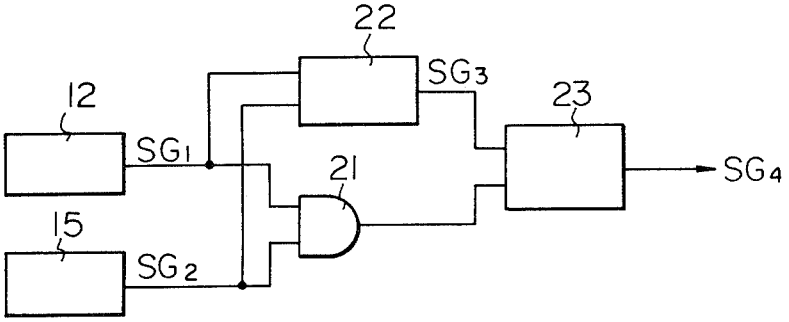
FIG. 6 is a block diagram of an electric circuit of the detecting apparatus illustrated in FIGS. 4 and 5.

An electric circuit utilized in the above embodiment of the detecting apparatus according to the present invention will now be explained with reference to FIG. 6. The electric circuit includes: an AND circuit 21 to which the output signals SG1 and SG2 emitted from the light receivers 12 and 15 are applied; and a timer 22 to which the output signals SG1 and SG2 are applied and which emits a signal SG3 having a time interval $T_3$ after a predetermined time delay interval T (FIG. 7) from the time either one of the signals SG1 or SG2 is input. The electric circuit further includes an inhibiting circuit 23, the input terminals of which are connected to the output terminals of the AND circuit 21 and the timer 22. The inhibiting circuit 23 emits an output signal SG4 when no signal is transmitted from the AND circuit, but a pulse signal SG3 is transmitted from said timer 22. The output signal SG4 is utilized to operate an alarm (not shown), such as a buzzer or an alarm lamp, or to stop the driver of the conveyor belt 2.

The detecting apparatus of this embodiment operates as follows. Prior to the bobbin changing operation, the conveyor belt 2 is moved in a direction denoted by an arrow A in FIG. 3, and empty bobbins 5 are withdrawn one by one from the empty bobbin storage box 8 by means of the empty bobbin feeding apparatus 10, as illustrated in FIG. 2. When an empty bobbin 5 is correctly inserted onto the empty bobbin supporting peg 4, the upper portion and the lower portion of the empty bobbin 5 begin to simultaneously interrupt the passages $L_1$ and $L_2$ of the upper and lower lights, and the output signals SG1 and SG2 are simultaneously emitted from the light receivers 12 and 15. As a result, in FIG. 6, the AND circuit 21 and the timer 22, to which the output signals SG1 and SG2 are applied, are energized, and the AND circuit emits an output signal at once and the timer emits an output signal after a lapse of a predetermined time period T. Thus, the inhibiting circuit 23, does not emit any output because both the outputs of the AND circuit 21 and the timer 22 are applied thereto, and therefore, the alarm is not actuated.

Figure 7:
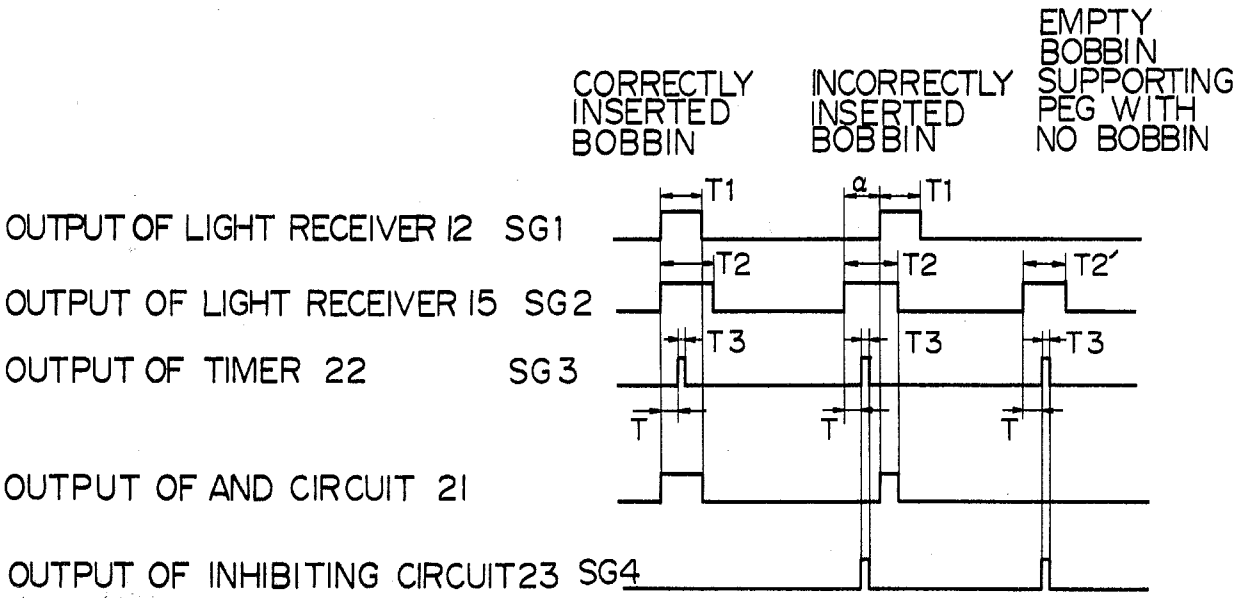
FIG. 7 is a diagram which illustrates the operation of the detecting apparatus illustrated in FIGS. 4 and 5.

When an incorrectly inserted empty bobbin 5' which is not tightly engaged with the empty bobbin supporting peg 4 and which inclines rearwards and projects upwards, as illustrated in FIG. 3, is conveyed by means of the conveyor belt 2, the upper portion of the empty bobbin interrupts the passage $L_1$ of the upper light after the lower portion of the empty bobbin has interrupted the passage $L_2$ of the lower light, and accordingly, the output signal SG1 (FIGS. 6 and 7) is emitted from the receiver 12 after a certain time interval $\alpha$ (FIG. 7) from the emission of the output signal SG2 (FIGS. 6 and 7) from the light receiver 15, as illustrated at the center of FIG. 7. Since the timer 22 is energized at the time the output signal SG2 is applied thereto and emits an output signal SG3, and since no signal is emitted from the AND circuit 21, the inhibiting circuit 23 emits an output signal SG4, which operates the alarm to notify an operator in charge of the spinning frame of the passage of the incorrectly inserted empty bobbin. Accordingly, prior to the simultaneous bobbin changing operation of the automatic bobbin doffing and donning apparatus, the operator of the spinning frame is able to find the incorrectly inserted empty bobbin 5' and repair its insertion, so that the empty bobbin 5 is correctly inserted onto the empty bobbin supporting peg 4. As a result, damage to the incorrectly inserted empty bobbin 5' and to the automatic bobbin doffing and donning apparatus can be prevented from occurring. Since the incorrectly inserted empty bobbin 5' is re-inserted correctly onto the empty bobbin supporting peg 4, the re-inserted empty bobbin 5 can be surely grasped by means of a bobbin catcher installed within the automatic bobbin doffing and donning apparatus and can be inserted onto the corresponding spindle of the spinning frame, whereby the spun yarn can be wound onto the bobbin 5, not wound onto the spindle. It should be noted that the timer 22 is so set that the sum of the time intervals T and $T_3$ is smaller than the certain time interval $\alpha$.

When an empty bobbin supporting peg 4' which has no empty bobbin inserted thereon, as illustrated at the left portion of FIG. 3, is moved with the conveyor belt 2, an output signal SG2 is emitted for a time interval $T_2'$ (FIG. 7) because the empty bobbin supporting peg 4' interrupts the passage $L_2$ of the lower light, but no output signal SG1 is emitted because the passage $L_1$ of the upper light is not interrupted. Accordingly, in FIG. 6 the AND circuit 21 is not energized; however, the timer 22 is energized by the receipt of the signal SG2 and transmits an output signal SG3 to the inhibiting circuit 23, then the inhibiting circuit 23 transmits an output signal SG4 to the alarm in order to actuate the alarm so as to notify an operator in charge of the spinning frame of the passage of the empty bobbin supporting peg 4' (FIG. 3) without an empty bobbin. The operator can insert a new empty bobbin 5 onto the empty bobbin supporting peg 4' (FIG. 3), and the winding of spun yarn around the spindle can be prevented.

In the above-explained embodiment, the present invention is applied to a so-called half pitch displacement type doffing and donning apparatus, wherein empty bobbin supporting pegs 4 and full bobbin supporting pegs 3 are alternately attached to a conveyor belt as illustrated in FIGS. 1 and 3 and the conveyor belt is moved by a half pitch of the pegs when full bobbins are replaced by empty bobbins. The present invention is also applicable to a so-called intermediate storage type doffing and donning apparatus, wherein an intermediate storage area having a plurality of pegs is utilized so that empty bobbins to be donned, or doffed full bobbins, are temporarily stored in the intermediate storage area and the distance between the pegs attached on both the conveyor belt and the distance between the pegs attached on the intermediate storage area are equal to the distance between the spindles of the spinning frame. In the latter case, the light emitter 14 and the light receiver 15 for detecting the passage $L_2$ of the lower light are so arranged that the passage is located higher than the upper surface of the belt conveyor 2 but lower than the top of the empty bobbin supporting pegs 4.

Another modification of the present invention, which is the second embodiment, will now be explained with reference to FIGS. 8 and 9. A support arm 31 is secured to the upper portion of the empty bobbin outlet 13, and the front end of the support arm 31 has a horizontal spindle 33 fixed thereto. A detecting plate 34 is swingably pivoted to the horizontal spindle 33, and the lower end of the detecting plate 34 hangs down to such a position that it is located just above the top of an empty bobbin 5 which is correctly inserted onto the empty bobbin supporting peg 4 and so that it abuts with the top of an empty bobbin 5' which is incorrectly inserted onto the empty bobbin supporting peg 4 causing it to incline rearwards and project upwards. A follower plate 35 is fixed to the base of the detecting plate 34, and accordingly, the follower plate 35 is rotated when the detecting plate 34 is rotated about the horizontal spindle 33. A magnet 36 is attached to the front end of the follower plate 35. A no arcing relay type switch, such as a reed switch 37, is fixed to the upper portion of the empty bobbin outlet 13 at such a position that it faces the magnet 36 when the follower plate 35 is swung to a position illustrated in a two dot and dash line in FIG. 8 together with the detecting plate 34. The reed switch is smoothly and rapidly actuated by the magnetic force of the magnet 36 so as to operate an alarm (not shown), such as a buzzer or an alarm lamp.

Figure 8:
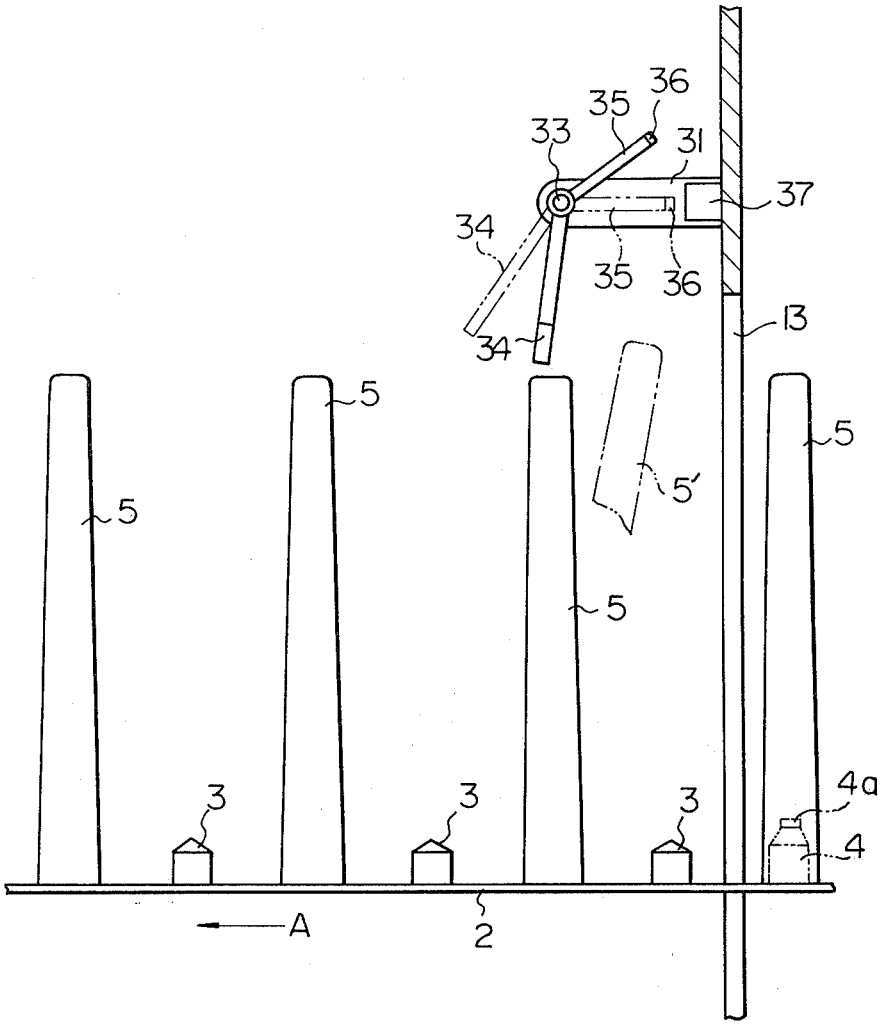
FIGS. 8 and 9 are elevational and side views of a second embodiment of a detecting apparatus according to the present invention.
Figure 9:
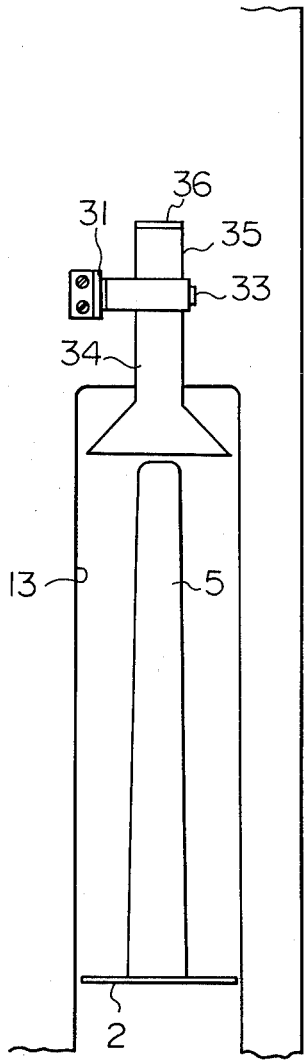

When an empty bobbin 5 is correctly inserted onto the corresponding empty bobbin supporting peg 4, the top of the correctly inserted empty bobbin 5 does not contact with the lower end of the detecting plate 34 as illustrated by solid lines in FIGS. 8 and 9. When an empty bobbin 5' is incorrectly inserted onto the corresponding empty bobbin supporting peg 5', as illustrated by a two dot and dash line in FIG. 8, the empty bobbin 5' projects upwards as previously explained, and accordingly, the detecting plate 34 comes into contact with the top of the incorrectly inserted empty bobbin 5' and is swung to a position illustrated in a two dot and dash line in FIG. 8. As a result, the reed switch 37 is actuated by means of the magnetic force of the magnet 36, and it acutates the alarm so as to notify an operator in charge of the spinning frame of the passage of the incorrectly inserted empty bobbin 5'. Based on the alarm, the operator can correct the incorrectly inserted empty bobbin 5' in a similar manner to that explained with regard to the first embodiment explained with reference to FIGS. 1 through 7. It should be noted that the detecting apparatus of the second embodiment cannot detect any empty bobbin supporting pegs 4 without empty bobbins. However, the second embodiment can detect the insertion of an empty bobbin which is excessively long and which may damage itself or the automatic bobbin doffing and donning apparatus when it is subjected to the bobbin changing operation.

Figure 10:
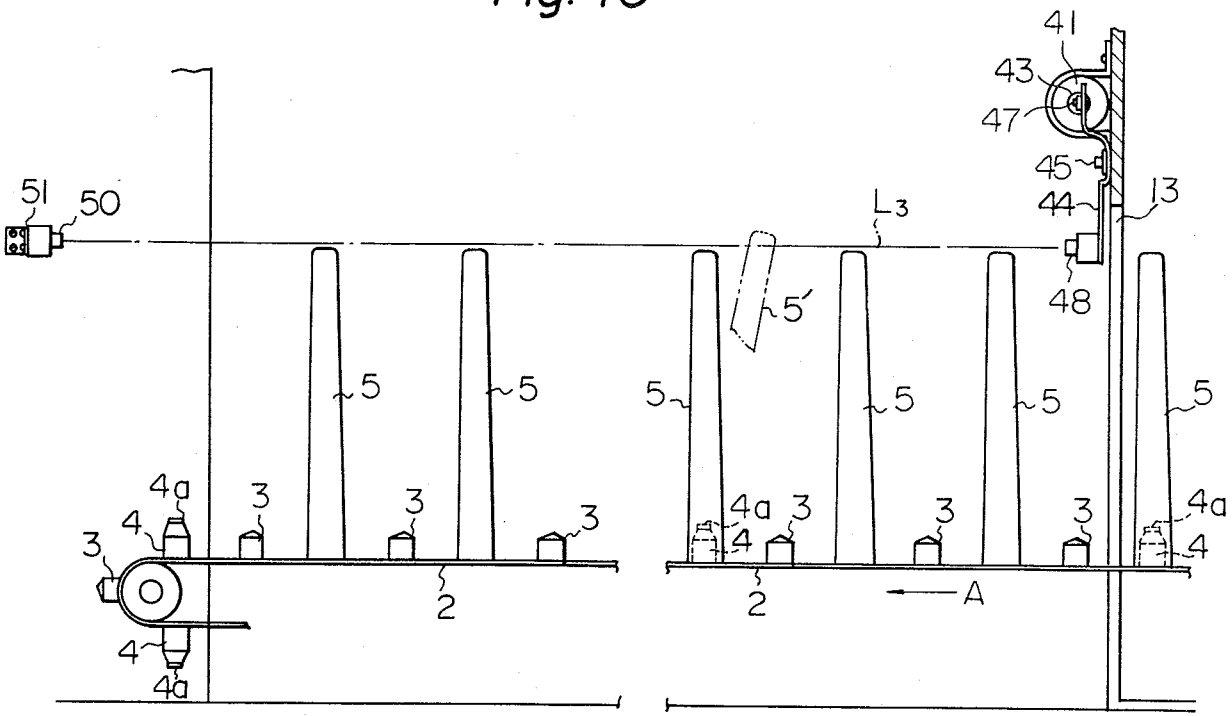
FIG. 10 is an elevational view of a light emitter and a light receiver of a third embodiment of a detecting apparatus according to the present invention.
Figure 11:
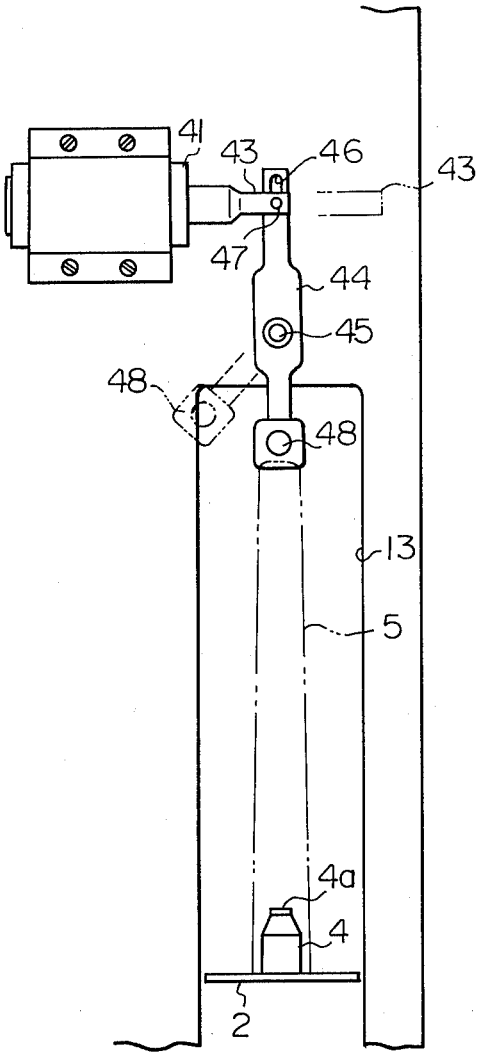
FIG. 11 is a side view of the light emitter illustrated in FIG. 10.
Figure 12:
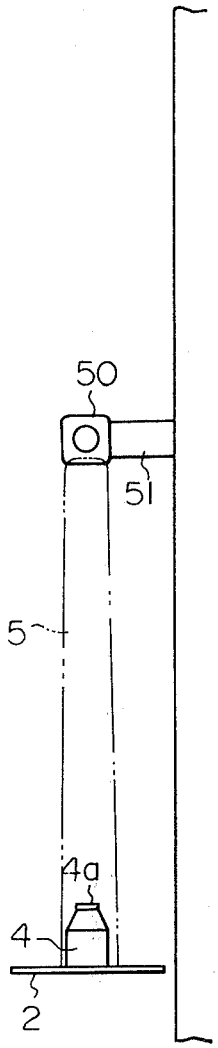
FIG. 12 is a side view of the light receiver illustrated in FIG. 10.

In the first and second embodiments of the detecting apparatus of the present invention, the detecting apparatuses detect every empty bobbin as to whether or not it is correctly inserted onto the corresponding empty bobbin peg 4. In the third embodiment, which will hereinbelow be explained with reference to FIGS. 10 through 12, a number of empty bobbins are detected as to whether or not they are correctly inserted onto the corresponding empty bobbin supporting pegs 4. An electromagnetic solenoid 41 is disposed at an upper portion of an empty bobbin outlet 13 and attracts an armature 43 when it is energized so that the armature 43 is moved from a stand-by position, illustrated by a two dot and dash line, to a working position, illustrated by a solid line in FIG. 11. In FIG. 10, a swing arm 44 is swingably supported by means of a horizontal spindle 45 fixed to a position above the empty bobbin outlet 13, and the swing arm 44 has an elogated hole 46 which is articulated to the front end of the armature 43 by means of a pin 47. A light emitter 48 is attached to the lower end of the swing arm 44, and it emits a light while the electromagnetic solenoid is energized, which light passes at a position just above the top of the correctly inserted empty bobbins 5 in the conveying direction of the conveyor belt 2 along a passage $L_3$ (FIG. 10). When the electromagnetic solenoid 41 is not energized, the attraction of the armature 43 is released so that the light emitter 48 is returned to the stand-by position, illustrated by a two dot and dash line in FIG. 11 by means of a spring (not shown) in order not to disturb the conveyance of the empty bobbins 5. A light receiver 50 is secured to the other side of the spinning frame via a support arm 51, as illustrated in FIGS. 10 and 12, so that it faces the light emitter 48 located in a working position, as illustrated by a solid line in FIGS. 10 and 11, in order to receive the light emitted from the light emitter 48 along the passage $L_3$ and in order to transmit an electric signal in accordance with the existence of the light. The electric signal from the light receiver 50 is applied to an alarm (not shown), such as a buzzer or an alarm lamp, so that the alarm is operated when the passage $L_3$ of the light is interruppted and the light receiver receives no light.

If an empty bobbin 5' is incorrectly inserted onto the empty bobbin supporting peg 4, as illustrated in FIG. 10 by a two dot and dash line, the incorrectly inserted empty bobbin 5' inclines backwards and projects upwards, as described previously, and interrupts the passage $L_3$ of the light emitted from the light emitter 48 towards the light receiver 50, and accordingly, the alarm is actuated and an operator of the spinning frame can repair the incorrectly inserted empty bobbin. In the above-explained embodiment, after a series of empty bobbins 5 are inserted onto the empty bobbin supporting pegs 4, the electromagnetic solenoid 41 and the light emitter 48 are energized so that the light receiver 50 detects whether or not the empty bobbins 5 are correctly inserted onto the empty bobbin supporting pegs 4. In some cases, the electromagnetic solenoid 41 and the light emitter 48 may be energized at each passage of an empty bobbin 5 through the empty bobbin outlet 13, so that the light receiver 50 can detect whether or not each empty bobbin 5 is correctly inserted onto the empty bobbin supporting peg 4.

In a not illustrated modification of the third embodiment, instead of the light emitter, the light receiver may be located at the empty bobbin outlet and may be so constructed that it is displaceable.

Figure 13:
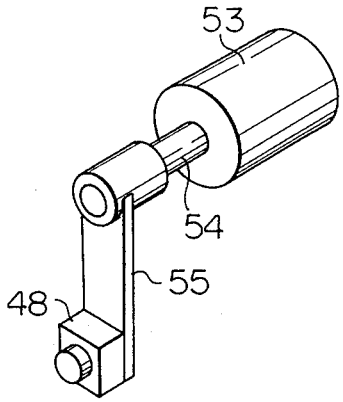
FIG. 13 is a perspective view of a light emitter according to a fourth embodiment of the present invention.

FIG. 13 illustrates a light emitter of fourth embodiment according to the present invention, wherein, instead of a swinging mechanism of the light emitter 48 by means of the electromagnetic solenoid 41, a reversible motor 53 is utilized. A swing arm 55 is fixed to the front end of: a rotary spindle 54 of the reversible motor 53 and has a light emitter 48 mounted thereon, so that the light emitter is displaceable, in accordance with the swinging motion of the swing arm 55, by means of the reversible motor 53.

We claim:

1. In a spinning frame provided with an automatic doffing and donning apparatus and an empty bobbin outlet, comprising a conveyor having empty bobbin supporting pegs mounted thereon, for feeding empty bobbins which are to be donned onto spindles of the spinning frame by means of said doffing and donning apparatus, the improvement comprising a detecting apparatus for detecting whether or not an empty bobbin is correctly inserted onto any one of said empty bobbin supporting pegs, said detecting apparatus comprising:

two photodetector circuits each comprising a pair of light emitters and light receivers, one pair being disposed at the upper portion of an empty bobbin outlet of said spinning frame and the other pair being disposed at the lower portion of said empty bobbin outlet, so that said light emitters face the corresponding light receivers sandwiching said conveyor therebetween, one of said two pairs being displaced from the other pair in an empty bobbin transfer direction of said conveyor by a distance corresponding to the difference in diameters of said upper and lower portions of said empty bobbin, so that passage of the upper and lower portions of said empty bobbin inserted onto any one of said empty bobbin supporting pegs is cooperatively detected by said photodetector circuits.

2. A spinning frame according to claim 1, wherein one pair composed of a light emitter and a light receiver is displaced by an amount which is equal to one half of the difference in the outer diameters of said empty bobbin at said upper and lower portions, relative to the other pair composed of a light emitter and a light receiver with respect to the empty bobbin conveying direction.

3. A spinning frame according to claim 1, which further comprises an alarm, wherein said light receivers of said two pairs detect the lights emitted from the corresponding light emitters of said pairs, and output signals emitted from said light receivers are input to said alarm.

4. A spinning frame according to claim 3, wherein said alarm is actuated based on said output signals emitted from said light receivers and a pulse signal, said pulse signal being emitted in synchronization with the passage of said empty bobbin.

5. In a spinning frame provided with an automatic doffing and donning apparatus and a conveyor having empty bobbin supporting pegs mounted thereon, for feeding empty bobbins which are to be donned onto spindles of the spinning frame by means of said doffing and donning apparatus, the improvement wherein said spinning frame is further provided with a detecting apparatus which detects whether or not an empty bobbin is correctly inserted onto any one of said empty bobbin supporting pegs, said detecting apparatus comprising a detecting member rotatably supported at a position just above that of the tops of said empty bobbins when correctly inserted onto said empty bobbin supporting pegs, and switching means coupled to said detecting apparatus for actuation by said detecting member when a bobbin is incorrectly inserted onto one of said empty bobbin supporting pegs.

6. A spinning frame according to claim 5, wherein said switch is of a no arcing relay type.

7. A spinning frame according to claim 6, wherein said detecting member comprises: a support arm fixed to said spinning frame; a detecting plate swingably supported by said support arm; and a follower plate, one end of which is fixed to said detecting plate and the other end of which has a magnet mounted thereon, and said no arcing relay type switch is a reed switch which is actuated by the magnetic force of said magnet.

8. In a spinning frame provided with an automatic doffing and donning apparatus and a conveyor having empty bobbin supporting pegs mounted thereon, for feeding empty bobbins which are to be donned onto spindles of the spinning frame by means of said doffing and donning apparatus, the improvement wherein said spinning frame is further provided with a detecting apparatus which detects whether or not an empty bobbin is correctly inserted onto any one of said empty bobbin supporting pegs, said detecting apparatus comprising a photodetector circuit pair comprising a light emitter and a light receiver, said circuit being so arranged that light emitted from said light emitter passes along said conveyor at a position just above the tops of said empty bobbins when the same have been correctly inserted onto said empty bobbin supporting pegs and is received by said light receiver, said light being interrupted by a bobbin incorrectly inserted onto one of said empty bobbin supporting pegs, so that the light is then not received by said light receiver.

9. A spinning frame according to claim 8, wherein at least one of said light emitter and light receiver is displaceable from said position.

10. A spinning frame according to claim 9, wherein said emitter is fixed to one end of a swing arm, the other end of which is connected to an armature of an electromagnetic solenoid and which is rotatably supported at the upper portion of the empty bobbin outlet of said spinning frame, so that said light emitter is displaceable from said position.

11. A spinning frame according to claim 10, which further comprises an alarm, wherein said light receiver detects the light emitted from said emitter, and an output signal emitted from said light receiver is input to said alarm.

* * * * *